US010113753B2

(12) United States Patent
Choi et al.

(10) Patent No.: US 10,113,753 B2
(45) Date of Patent: Oct. 30, 2018

(54) DISCHARGING UNIT AND AIR CONDITIONING EQUIPMENT HAVING THE SAME

(71) Applicant: Samsung Electronics Co., Ltd., Gyeonggi-do (KR)

(72) Inventors: Sun-muk Choi, Gyeonggi-do (KR); Sang-hak Kim, Gyeonggi-do (KR); Jung-ho Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 14/923,224

(22) Filed: Oct. 26, 2015

(65) Prior Publication Data

US 2016/0153670 A1 Jun. 2, 2016

(30) Foreign Application Priority Data

Nov. 27, 2014 (KR) ..... 10-2014-0167406

(51) Int. Cl.
*F25D 17/04* (2006.01)
*F24F 1/02* (2011.01)
(Continued)

(52) U.S. Cl.
CPC ..... *F24F 1/025* (2013.01); *F24F 1/0007* (2013.01); *F24F 7/08* (2013.01); *F24F 11/79* (2018.01);
(Continued)

(58) Field of Classification Search
CPC .. F24F 1/025; F24F 13/082; F24F 7/08; F24F 13/065; F24F 13/072; F24F 13/105;
(Continued)

(56) References Cited

U.S. PATENT DOCUMENTS 3,308,634 A * 3/1967 Smith ..... F24F 1/02 52/21
4,326,452 A * 4/1982 Nawa ..... F15D 1/08 137/829

(Continued)

FOREIGN PATENT DOCUMENTS

EP 1 519 119 A2 3/2005
EP 2 587 178 A1 5/2013

(Continued)

OTHER PUBLICATIONS

Extended European Search Report dated May 13, 2016 in connection with European Appl. No. 15188637.1; 6 pages.

*Primary Examiner* — Ana Vazquez

(57) ABSTRACT

A discharging unit and air conditioning equipment having the discharging unit are provided. The air conditioning equipment includes a main body including a housing that houses a heat exchanger and a blowing fan and an inlet and an outlet formed in an outer surface of the housing, wherein interior air flows into the inlet and the air exchanged with heat is discharged through the outlet. The air conditioning equipment also includes a discharging part including an end detachably combined with the outlet. The discharging part includes a plurality of discharging units configured to adjust a discharging velocity and discharging direction of the discharged air and to be connected to one another so as to be made into a module.

14 Claims, 12 Drawing Sheets

(51) Int. Cl.

| | |
|---|---|
| ***F24F 1/00*** | (2011.01) |
| ***F24F 13/065*** | (2006.01) |
| ***F24F 13/10*** | (2006.01) |
| ***F24F 7/08*** | (2006.01) |
| ***F24F 13/08*** | (2006.01) |
| ***F24F 11/79*** | (2018.01) |

(52) U.S. Cl.
CPC ..... *F24F 13/065* (2013.01); *F24F 13/082* (2013.01); *F24F 13/105* (2013.01); *F24F 2001/004* (2013.01); *F24F 2221/36* (2013.01)

(58) Field of Classification Search
CPC ..... F24F 2001/004; F24F 1/0007; F24F 11/0078; F24F 1/02; F24F 2221/36; F24F 11/79; B60H 1/3222
See application file for complete search history.

(56) References Cited

U.S. PATENT DOCUMENTS

| | | | | |
|---|---|---|---|---|
| 5,037,585 | A * | 8/1991 | Alix | B64D 13/00 261/116 |
| 5,857,906 | A | 1/1999 | Cho | |
| 2005/0284168 | A1 * | 12/2005 | Lee | F24F 1/0007 62/317 |

FOREIGN PATENT DOCUMENTS

| | | | |
|---|---|---|---|
| JP | S 58-85045 | A | 5/1983 |
| WO | WO 2013/121168 | A1 | 8/2013 |

* cited by examiner

DISCHARGING UNIT AND AIR CONDITIONING EQUIPMENT HAVING THE SAME

CROSS-REFERENCE TO RELATED APPLICATION AND CLAIM OF PRIORITY

The present application relates to and claims priority under 35 U.S.C. § 119 from Korean Patent Application No. 10-2014-0167406, filed on Nov. 27, 2014, in the Korean Intellectual Property Office, the disclosure of which is incorporated herein by reference in its entirety.

TECHNICAL FIELD

The present general inventive concept generally relates to providing air conditioning equipment, and more particularly, to providing air conditioning equipment that may realize various types of blowing air currents.

BACKGROUND

Air conditioning equipment has been widely used in all areas of our lives as an apparatus that performs humidifying, dehumidifying, cooling, and heating by using a refrigerant cycle. Among pieces of air conditioning equipment described above, stand type air conditioning equipment that is widely used in general homes is standardized in a circular shape, a polygonal shape, or a pillar shape having a similar cross-section to the polygonal shape. Air conditioning equipment having a structured as mentioned above mostly includes an interior air inlet on a back surface thereof, and exchanges air flowing in through the interior air inlet with heat inside and then discharges the air through an outlet formed in a front surface.

SUMMARY

To address the above-discussed deficiencies, it is a primary object to provide air conditioning equipment that variously adjusts a discharging velocity and a discharging direction of air blowing into an interior through a manipulation of a user. The exemplary embodiments also provide air conditioning equipment that easily changes maintenance procedures and a design thereof through a discharging part which can be separated from a main body and includes a plurality of discharging units made into a module.

In a first embodiment, an air conditioning equipment is provided. The air conditioning equipment includes a main body configured to include a housing including a heat exchanger and a blowing fan formed in the housing. The air conditioning equipment also includes an inlet and an outlet formed in an outer surface of the housing, wherein interior air flows into the inlet and the air exchanged with heat is discharged through the outlet. The air conditioning equipment further includes a discharging part configured to include an end detachably combined with the outlet. The discharging part may include a plurality of discharging units configured to adjust a discharging velocity and discharging direction of the discharged air and to be connected to one another so as to be made into a module.

The discharging units may include main ducts configured to be connected to the main body and outer surfaces in which openings are formed. The discharging units also include diffusers configured to be combined with the outer surfaces of the main ducts so as to rotate on the outer surfaces of the main ducts. The diffusers rotate in one direction or a reverse direction to adjust opened degrees of the openings. The main ducts include connection parts configured to be formed at both ends of each of the main ducts so as to enable the plurality of discharging units to be connected to one another through the connection parts.

The diffusers may include closing parts configured to be formed at some parts of the diffusers so as to close the openings and connection parts configured to be formed at other parts of the diffusers so as to be connected to the openings. The closing parts and the connection parts are formed along circumferences of the diffusers. The connection parts include at least two or more discharging holes having different areas. Areas of the at least two or more discharging holes are set by distances between first and second guide ribs formed at both ends of the diffusers.

The diffusers of the discharging units can have different sizes. As the diffusers of the discharging units become far away from the outlet, the diffusers of the discharging units may be gradually arranged in order from their largest sizes or their smallest sizes. The discharging part may further include a cover configured to be detachably combined with another end of the discharging part. The cover may include a case configured to include at least one opening and closing hole and a shutter part configured to be rotatably combined with the case in order to open and close the at least one opening and closing hole.

The discharging part may further include an adaptor configured to be disposed between the outlet and an end of the discharging part so as to be connected to the discharging part. The adaptor divides a flow path of air discharged from the outlet into two or more flow paths. A plurality of discharging parts can be disposed to be respectively connected to the two or more flow paths. At least one or more outlets can be formed in an upper surface or a side of the main body. The discharging parts can be disposed so as to correspond to the number of outlets.

The discharging units may further include filters configured to be disposed in the discharging units. The main body can further include a humidifying unit configured to adjust humidity. The humidifying unit includes a water supply unit configured to be disposed on the upper surface of the main body. The humidifying unit also includes a humidifying part configured to be disposed in the main body so as to convert water supplied to the water supply part into fine water particles. The humidifying unit further includes a nozzle configured to spout the fine water particles. The humidifying unit can be driven according to one selected from an ultrasonic method, a heating method, and a complex method including the ultrasonic method and the heating method.

The air conditioning equipment also include a main body configured to comprise a heat exchanger, a blowing fan, an inlet, and an outlet, wherein interior air flows into the inlet and the air exchanged with heat is discharged to the outlet. The air conditioning equipment further includes a discharging part comprising a plurality of discharging units, at least two or more of which are detachably connected to one another in a line. At least one discharging unit of the discharging part may be detachably connected to the outlet of the main body. The plurality of discharging units may respectively adjust discharging velocities and discharging directions of air. The plurality of discharging units include main ducts comprising openings formed in surfaces of the main ducts, and diffusers configured to adjust opened degrees of the openings of the main ducts and set discharging directions of air discharged from the openings.

The main ducts can have cylindrical shapes having opened sides, and the diffusers may be inserted into outer surfaces of the main ducts to rotate on the outer surfaces of the main ducts. The diffusers include at least two or more discharging holes having different areas. The plurality of discharging units may have different sizes. The air conditioning equipment can further include a cover configured to be detachably combined with one of the plurality of discharging units disposed in a place farthest away from the main body.

In a second embodiment, a discharging unit is provided. The discharging unit includes a main duct configured to be connected to an air blowing source and including an opening formed in an outer surface of the main duct. The discharging unit also includes a diffuser configured to be combined with an outer surface of the main duct to rotate on the outer surface of the main duct. The diffuser can rotate in one direction or a reverse direction to adjust an opened degree of the opening.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
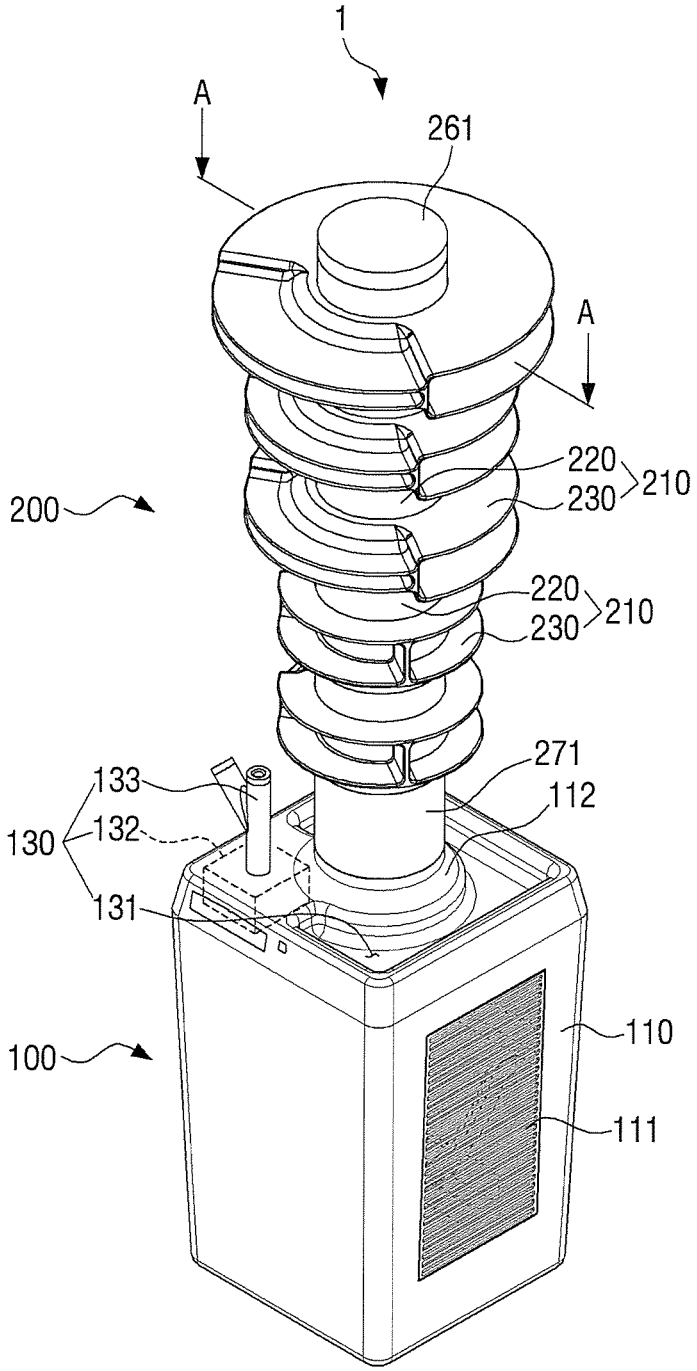
FIG. 1 is a perspective view of an example air conditioning equipment according to this disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged air conditioning equipment or air conditioning system. Exemplary embodiments are described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

Air conditioning equipment has been widely used in all areas of our lives as an apparatus that performs humidifying, dehumidifying, cooling, and heating by using a refrigerant cycle. Among pieces of air conditioning equipment described above, stand type air conditioning equipment that is widely used in general homes is standardized in a circular shape, a polygonal shape, or a pillar shape having a similar cross-section to the polygonal shape. Air conditioning equipment having a structured as mentioned above mostly includes an interior air inlet on a back surface thereof, and exchanges air flowing in through the interior air inlet with heat inside and then discharges the air through an outlet formed in a front surface. Therefore, it is difficult to variously form a discharging direction. For this, there has been recently launched air conditioning equipment that includes an outlet rotating at preset angles from side to side and adjusts a discharging direction to a uniform direction. However, a discharging direction that may be adjusted by the air conditioning equipment is limited. Also, a driving force of a blowing fan may be adjusted to adjust a flow velocity of air discharged into an interior. Therefore, if a user wants air having a fast flow velocity, a high driving force may be applied to the blowing fan, and thus a large amount of electricity may be used. In addition, there has been recently launched air conditioning equipment where various colors are combined to be printed on a housing so as to give an aesthetic effect to a user. However, a whole external appearance of the air conditioning equipment is still standardized.

Figure 2:
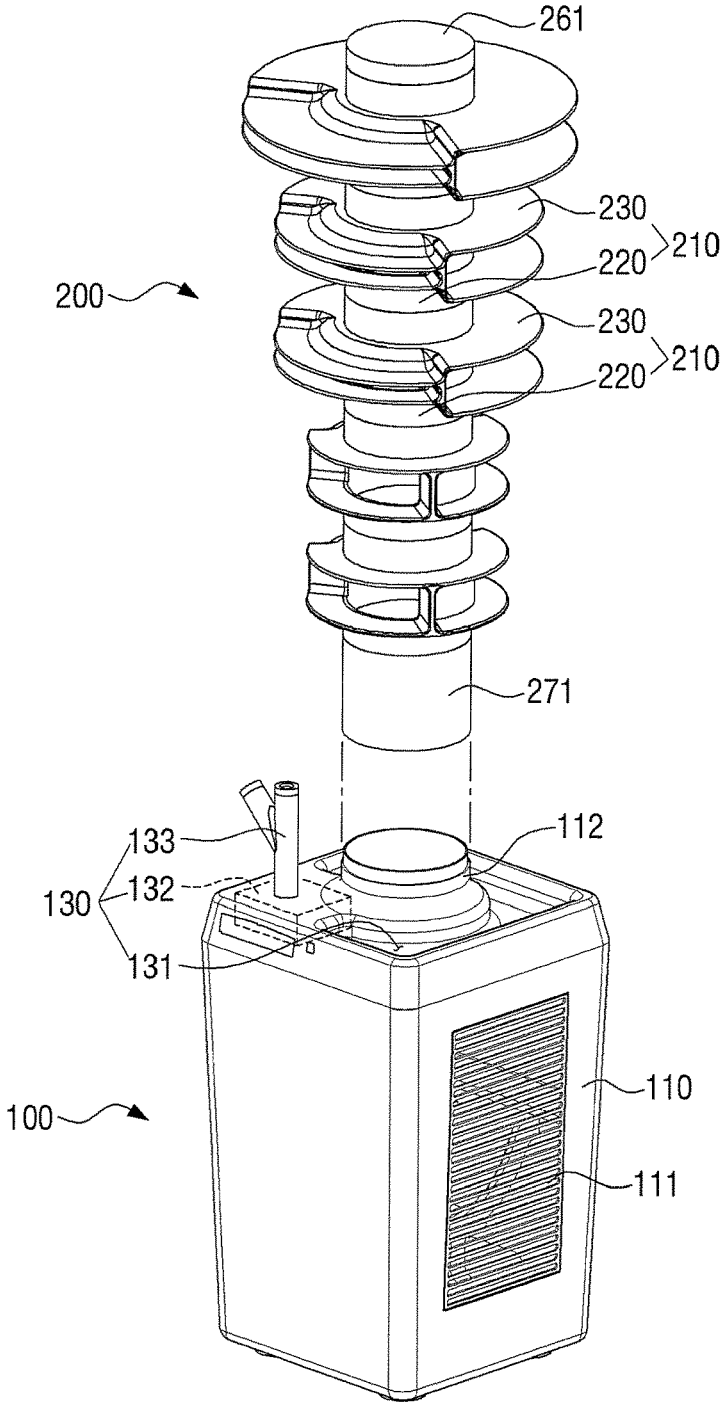
FIG. 2 is an exploded perspective view of an example air conditioning equipment from which discharging units are separated according to this disclosure.

Referring to FIGS. 1 and 2, air conditioning equipment 1 according to an exemplary embodiment of the present general inventive concept cools and heats an interior, and includes a main body 100 and a discharging part 200. The air conditioning equipment 1 has a similar shape to a shape where a tree is planted into a flowerpot and thus gives an eco-friendly aesthetic effect to a user. The main body 100 enables interior air to flow into an inside thereof, exchanges the interior air with heat, and discharges the air to the discharging part 200. The main body 100 includes a housing 110.

The housing 110 forms an external appearance of the main body 100, and includes an inlet 111 and an outlet 112. The inlet 111 is formed in a side of the housing 110, and a plurality of inlets 111 is formed to enable interior air to flow into an inside thereof. The inlet 111 is formed of a plurality of long holes as shown in FIGS. 1 and 2. In this case, the inlet 111 has circular holes or polygonal holes besides the long holes, and these holes are regularly or irregularly arranged. The outlet 112 is formed in an upper surface and discharges the air, which is exchanged with the heat, to the discharging part 200. The outlet 112 is combined with an end of the discharging part 200 to be connected to the discharging part 200.

Also, the inlet 111 is formed in the side of the housing 110, and the outlet 112 is formed in the upper surface of the housing 110. However, the present general inventive concept is not limited thereto, and thus the inlet 111 and the outlet 112 are respectively formed in an arbitrary one of the upper surface and sides of the housing 110. In other words, the inlet 111 is formed in the upper surface of the housing 110, and the outlet 112 is formed in the side of the housing 110. Alternatively, the inlet 111 and the outlet 112 are formed in each side of the housing 110. Also, a plurality of inlets 111 and a plurality of outlets 112 are formed in the housing 110.

The housing 110 includes a heat exchanger (not shown) and a blowing fan (not shown). The heat exchanger exchanges the air flowing into the inlet 111 with heat. In detail, the heat exchanger absorbs heat from air flowing into in summer, and heats and discharges the air in winter. The heat exchanger is disposed to be close to the inlet 111, and if a plurality of inlets 111 are formed, the number of heat exchangers corresponds to the number of inlets 111. The blowing fan discharges the air, which is exchanged with the heat in the heat exchanger, outside the housing 110 through the outlet 112. Therefore, the blowing fan is disposed to be close to the outlet 112, and if a plurality of outlets 112 are formed, the number of blowing fans corresponds to the number of outlets 112.

However, differently from the above description, the heat exchanger is disposed to be close to the outlet 112, and the blowing fan is disposed to be close to the inlet 111. The main body 100 of the air conditioning equipment 1 according to the present exemplary embodiment further includes a humidifying unit 130. The humidifying unit 130 raises humidity if the interior is dry, and is disposed at an upper end of the main body 100 staying away from the outlet 112. However, a position of the humidifying unit 130 is not limited thereto, and thus the humidifying unit 130 is disposed in any position of the main body 110 which does not interfere with a flow path of air, the heat exchanger, and the blowing fan of the main body 100. The humidifying unit 130 includes a water supply part 131, a humidifying part 132, and a nozzle 133.

The water supply part 131 is a part that supplies water so as to enable the user to use a humidifying function and that is grooved in the upper surface of the main body 100 in the present exemplary embodiment. However, a position of the water supply part 131 enables the user to supply the humidifying unit 130 with water like watering the flowerpot so as to give an aesthetic effect to the user and cause an interest of the user. The humidifying part 132 converts water supplied to the water supply part 131 into fine water particles to make the water in a state that is sprayed into the interior. The humidifying part 132 is disposed on an upper end of the main body 100 but is not limited thereto. Therefore, the humidifying part 132 is disposed outside the main body 100. In this case, the humidifying part 132 uses one selected from an ultrasonic method, a heating method, and a complex method including the ultrasonic method and the heating method.

The nozzle 133 discharges the fine water particles, into which the water is converted by the humidifying part 132, into the interior. The nozzle 133 is disposed on the upper surface of the main body 100 in the present exemplary embodiment but is not limited thereto. Therefore, the nozzle 133 is disposed on a side of the main body 100. Also, as shown in the present exemplary embodiment, the nozzle 133 includes two humidifying holes but includes one or three or more humidifying holes.

Referring to FIG. 2, the discharging part 200 is detachably combined with the main body 100 to be connected to the main body 100. Here, screw threads are formed at ends of the outlet 112 and the discharging part 200 to combine the outlet 112 and the discharging part 200 so as to enable the user to easily combine the outlet 112 and the discharging part 200 and separate the outlet 112 and the discharging part 200 from each other. Also, the discharging part 200 is placed on the outlet 112 and then is combined with the outlet 112 by using a bolt and nut or the discharging part 200 and the outlet 112 is hooked into each other. However, a combination method between the outlet 112 and the discharging part 200 is not limited to the above-described example, and thus any combination method that is expected by those skilled in the art is applied.

Figure 3:
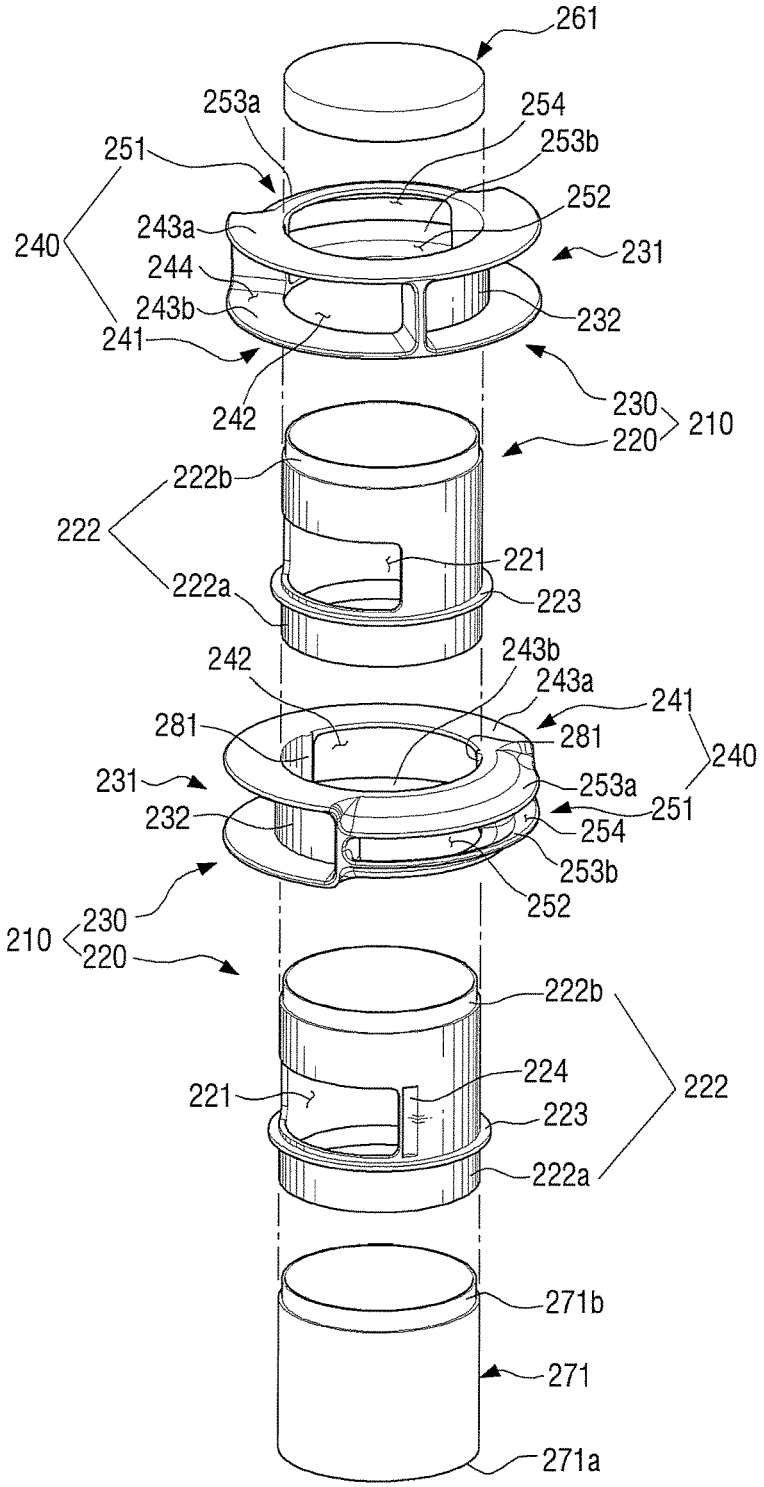
FIG. 3 is an exploded perspective view of example discharging units according to this disclosure.

Referring to FIG. 3, the discharging part 200 includes a plurality of discharging units 210, a cover 261, and an adaptor 271. Also, the main body 100, the adaptor 271, the plurality of discharging units 210, and the cover 261 are sequentially connected to one another. The discharging units 210 discharge air, which flows from the main body 110 through the outlet 112, into the interior and adjust a discharging velocity and a discharging direction of the discharged air. Also, the user additionally connects discharging units 210 to one another to a desired height or uses only one discharging unit 210. The discharging units 210 include main ducts 220 and diffusers 230.

The main ducts 220 enable air, which inflows from the main body 110, to flow therethrough and have duct shapes each having both opened ends to enable the diffuser 230 to rotate along outer surfaces of the main ducts 220. The main ducts 220 include openings 221, combination parts 222, and placing parts 223. The openings 221 are formed in the outer surfaces of the main ducts 220 and are selectively connected to the diffusers 230 so as to discharge air, which flows in the main ducts 220, into the interior. The openings 221 are formed in rectangular shapes in the present exemplary embodiment but can be formed in circular or elliptical shapes. Also, the openings 221 have shapes corresponding to connection holes 242 and 252.

Each of the combination parts 222 is formed at both ends of the main ducts 220, and the combination parts 222 are connected to one another so as to connect the plurality of discharging units 220 to one another. In the present exemplary embodiment, the combination parts 222 are formed so as to enable inner surfaces of ends 222*a* of the main ducts 220 to contact outer surfaces 222*b* of the main ducts 220 and thus enable the ends 222*b* to be inserted into the ends 222*a*. However, the combination parts 222 are not limited thereto and thus can be formed so as to enable the ends 222*a* to rotate on the ends 222*b*. The main ducts 220 of the plurality of discharging units 210 individually rotate through the combination parts 222. Therefore, the air conditioning equipment 1 according to the present exemplary embodiment freely adjusts a discharging direction of air discharged into the interior.

The placing parts 223 support the diffusers 230 so as to enable the diffusers 230 to be kept in positions where the diffusers 230 are combined with the main ducts 220 to rotate along the outer surfaces of the main ducts 220. The placing parts 223 protrude from the outer surfaces of the main ducts 220 in the present exemplary embodiment but are not limited thereto. Therefore, protrusions of the placing parts 223 are formed at inner surfaces of the diffusers 230, and grooves of the placing parts 223 are formed in the outer surfaces of the main ducts 220 so as to fix positions of the main ducts 220 and the diffusers 230.

Figure 4:
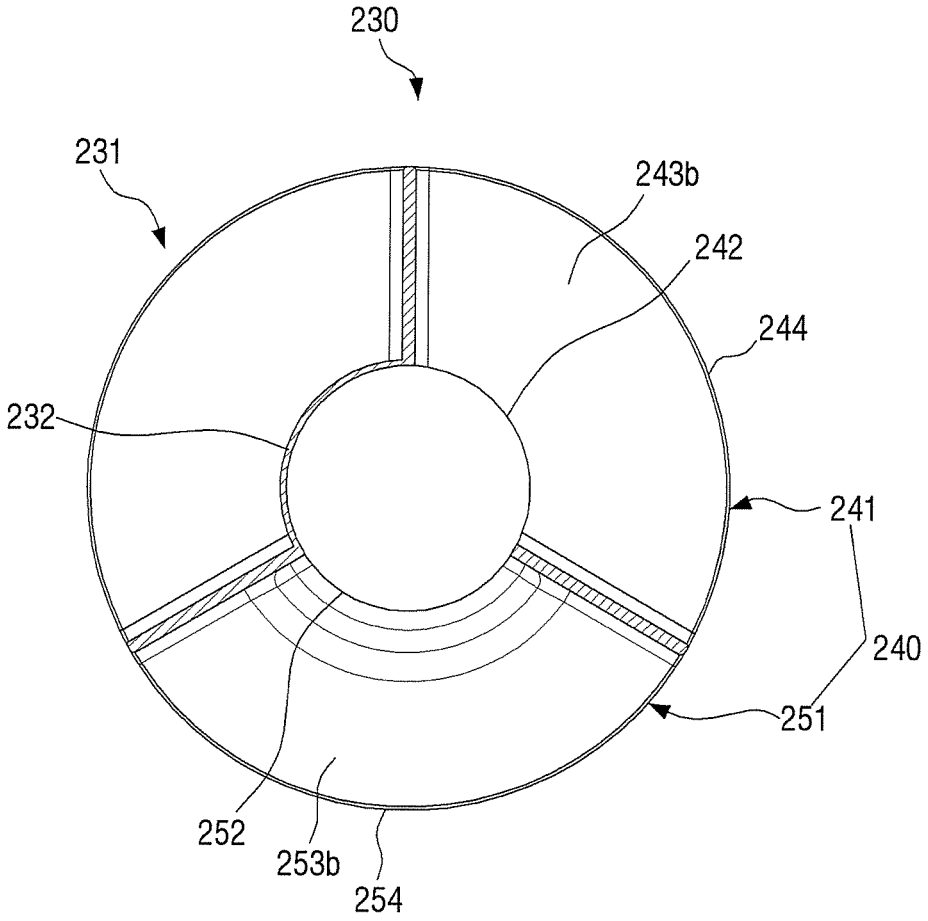
FIG. 4 is a cross-sectional view of an example air conditioning equipment according to this disclosure.

Referring to FIGS. 3 and 4, the diffusers 230 have pillar shapes having lower heights than the main ducts 220. Also, inner surfaces of the diffusers 230 contact the outer surfaces of the main ducts 220 so as to enable the diffusers 230 to be combined with and rotate on the main ducts 220. The diffusers 230 includes closing parts 231 and connection parts 240 that rotate on the outer surfaces of the main ducts 220 and selectively meet the openings 221.

The closing parts 231 include blocking plates 232 for blocking the openings 221. The blocking plates 232 are formed so as to correspond to areas and shapes of the openings 221 along the inner surfaces of the diffusers 230. Therefore, if the closing parts 231 meet the openings 221, the openings 221 are blocked, and discharging of air into the interior is blocked. The connection parts 240 include low-speed parts 241 and high-speed parts 251 that differently form flow velocities of discharged air.

The low-speed parts 241 slowly form a flow velocity of air discharged into the interior and enable the user to indirectly feel cooled and heated air. The low-speed parts 241 include first connection holes 242, first guide ribs 243*a*, second guide ribs 243*b*, and first discharging holes 244. The first connection holes 242 are formed to correspond to areas and shapes of the openings 221 along the inner surfaces of the diffusers 230 so as to be connected to the openings 221. Therefore, if the low-speed parts 241 meet the openings 221, the openings 221 are opened so as to enable air to be discharged into the interior. The first and second guide ribs 243*a* and 243*b* form a path of air so as to enable air flowing through the first connection holes 242 to go toward the first discharging holes 244. Here, distances between the first and second guide ribs 243*a* and 243*b* of the low-speed parts 241 are kept uniform from the first connection holes 242 toward the first discharging holes 244 so as to form the first discharging holes 244 having wider areas than the high-speed parts 251 that will be described later.

The first discharging holes 244 are formed in the outer surfaces of the diffusers 230 and discharge air into the interior. Discharging areas of the first discharging holes 244 are set by the first and second guide ribs 243*a* and 243*b* described above. The first discharging holes 244 of the low-speed parts 241 are formed in relatively wide areas and thus slowly form a flow velocity of air. Therefore, if cooling and heating are performed through the low-speed parts 241, the user may delicately cool and heat the interior. The high-speed parts 251 quickly form a flow velocity of air discharged into the interior and enable the user to directly feel cooled and heated air. The high-speed parts 251 include second connection holes 252, third guide ribs 253*a*, fourth guide ribs 253*b*, and second discharging holes 254.

Like the first connection holes 242, the second connection holes 252 are formed to correspond to the areas and shapes of the openings 221 along the inner surfaces of the diffusers 230 so as to be connected to the openings 221. Therefore, if the high-speed parts 251 meet the openings 221, the openings 221 are opened to enable air to be discharged into the interior. The third and fourth guide ribs 253*a* and 253*b* form a flow path of air so as to enable air flowing through the connection holes 252 to go toward the second discharging holes 254. Here, distances between the third and fourth guide ribs 253*a* and 253*b* of the high-speed parts 251 become narrower from the second connection holes 252 toward the second discharging holes 254. Therefore, areas of the second discharging holes 254 are narrower than areas of the first discharging holes 244.

The second discharging holes 254 are formed in the outer surfaces of the diffusers 230 and discharge air into the interior. Discharging areas of the second discharging holes 254 are set by the third and fourth guide ribs 253*a* and 253*b* described above. The second discharging holes 254 of the high-speed parts 251 are formed in relatively narrow areas and thus relatively quickly form a flow velocity of discharged air. Therefore, if the user performs cooling and heating, the user may intensively first cool and heat a particular region.

If a flow of air is uniform, a flow velocity of the air rises in a narrow area. Therefore, areas of discharging holes are differently formed as described above so as to enable the air conditioning equipment 1 according to the present exemplary embodiment to differently set a flow velocity of air discharged into the interior even if the air conditioning equipment 1 rotates at the same driving force. In the air conditioning equipment 1 according to the present exemplary embodiment, the closing parts 231, the low-speed parts 241, and the high-speed parts 251 are distinguished from one another along circumferences of the diffusers 230. If three different modes are included as in the present exemplary embodiment, the closing parts 231, the low-speed parts 241, and the high-speed parts 251 are formed to respectively equally occupy the circumferences of the diffusers 230 by each about 120° as shown in FIG. 4. Also, the openings 221 are formed by 120° so as to correspond to parts where modes are respectively formed.

Also, the diffusers 230 include the three different modes in the present exemplary embodiment. However, the connection parts 240 are divided into three or more parts to further variously set a flow velocity of air discharged into the interior. Also, the diffusers 230 are simply divided by 180° to be divided into the closing parts 231 and the connection parts 240. In addition, the openings 221 are formed to correspond to parts into which the closing parts 231 and the connection parts 240 are formed to be divided. Also, the diffusers 230 according to the present exemplary embodiment include fixing parts 281 that protrude from boundary parts of the inner surfaces of the diffusers 230 between the closing parts 231 and the connection parts 240. The fixing parts 281 are combined with fixing grooves 224 formed in the outer surfaces of the main ducts 220 in a direction perpendicular to a rotation direction of the diffusers 230 so as to enable the diffusers 230 rotating on the main ducts 220 to be fixed in a position for performing one of the above-described modes. However, the fixing parts 281 are not limited thereto and thus have any structures that fixes the diffusers 230 in one position.

Also, the diffusers 230 included in the plurality of discharging units 210 have different sizes. Therefore, the diffusers 230 differently form a flow velocity of air discharged into the interior. In detail, if the sizes of the diffusers 230 are small, the diffusers 230 are appropriate for discharging air into a place close to the air conditioning equipment 1. If the sizes of the diffusers 230 are large, the diffusers 230 are appropriate for discharging air into a place far away from the air conditioning equipment 1.

Figure 5:
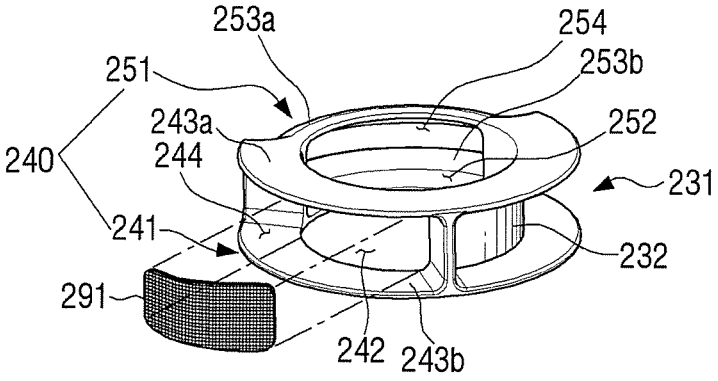
FIG. 5 is an exploded perspective view of example diffusers according to this disclosure.

In addition, referring to FIG. 5, a filter 291 is disposed in the connection hole 242 of the diffuser 230. The filter 291 removes foreign substances included in air discharged into the interior to prevent interior air from being contaminated. The filter 291 is not limited thereto and thus is disposed in the discharging hole 244 or in the opening 221 of the main duct 220. Also, the filter 291 is disposed only in the low-speed part 241 in FIG. 5 but is disposed in the high-speed part 251 or in both of the low-speed part 241 and the high-speed part 251.

The cover 261 is disposed at the end 222*b* of the main duct 220 of the last one of the plurality of discharging units 210 that are stacked. The cover 261 guides air flowing from the main body 100 by the flowing fan so as to enable the air not to be discharged toward upper ends of the discharging units 210 but to be discharged into the openings 221 respectively formed in the plurality of discharging units 210.

Figure 6:
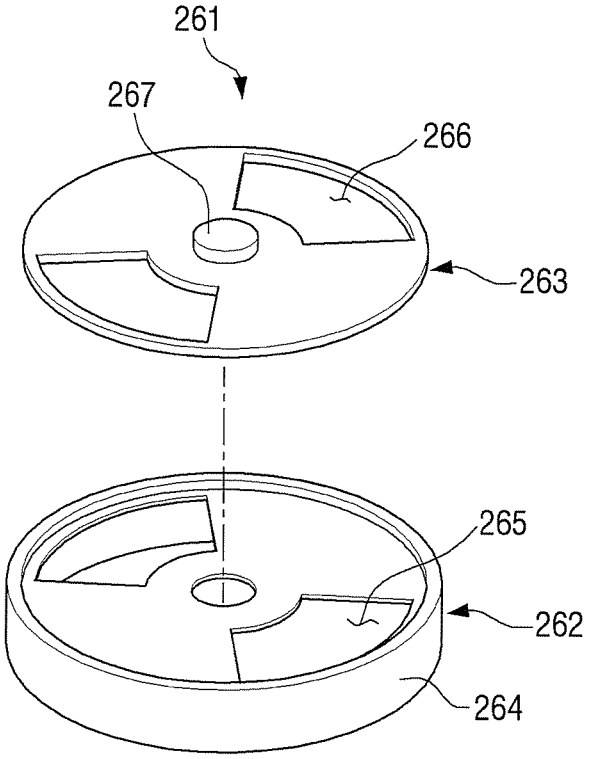
FIG. 6 is an exploded perspective view of an example cover according to this disclosure.
Figure 7:
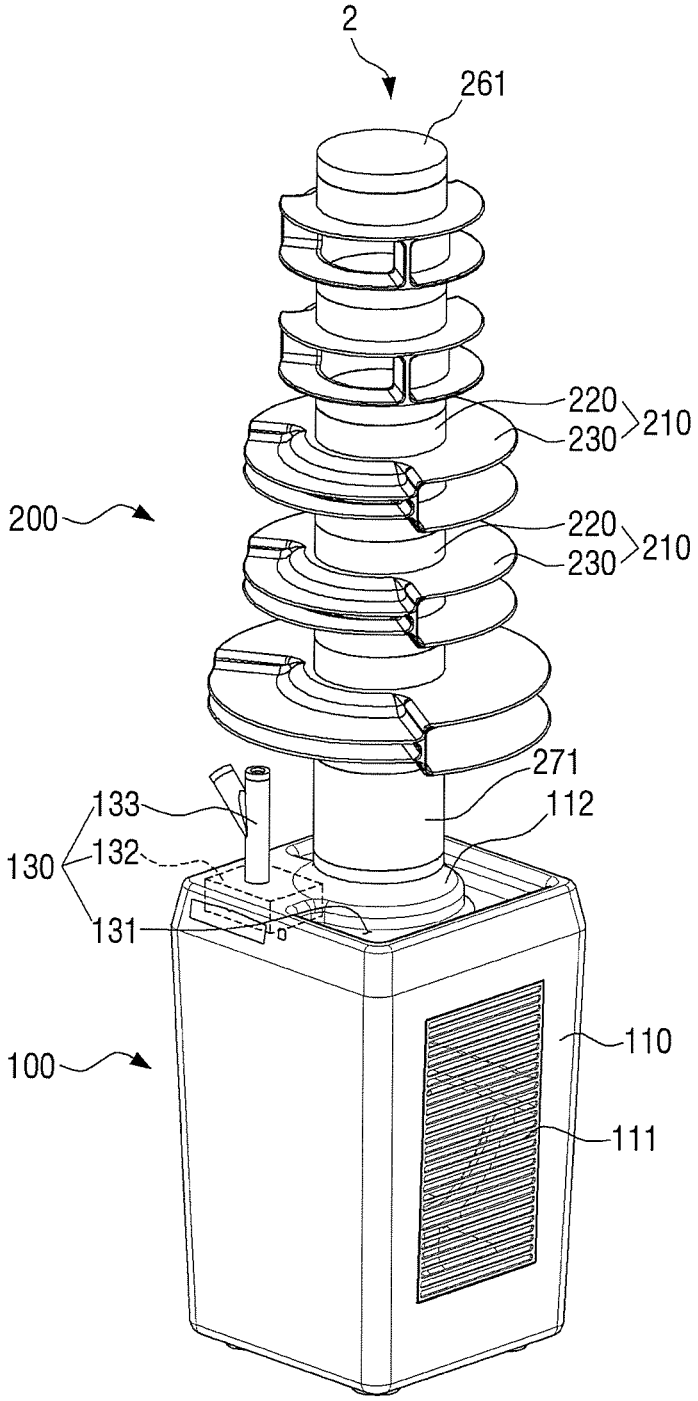
FIG. 7 is a perspective view of an example air conditioning equipment according to this disclosure.

Referring to FIG. 6, the cover 261 includes a case 262 and a shutter part 263. The case 262 includes a connection part 264 that forms an external appearance of the cover 261 and is connected to the end 220*b* of the main duct 220. In the present exemplary embodiment, an inner surface of the connection part 264 contacts an outer surface of the end 220*b* of the main duct 220 so as to connect the connection part 264 to the main duct 220. However, the cover 261 is not limited thereto and has any structure that is detachably combined with the main duct 220.

Also, a first opening and closing hole 265 is formed in a surface of the case 262, on which the shutter part 263 is disposed, to be selectively opened and closed by the shutter part 263. The first opening and closing hole 265 is selectively connected to a second opening and closing hole 266 by driving of the shutter part 263. The shutter part 263 is hinged on a surface of the case 262 through a hinge part 267. Also, the second opening and closing hole 266 is formed in a surface of the shutter part 263 so as to be connected to the first opening and closing hole 265. Therefore, the shutter part 263 rotates on an upper surface of the case 262 based on the hinge part 267, and thus the first opening and closing hole 265 selectively meets the second opening and closing hole 266 through the rotation of the shutter part 263.

Through the shutter part 263, the user discharges air flowing through the discharging part 200 into the interior through the discharging units 210. On the contrary, the user sets the shutter part 263 to discharge air toward an upper part of the discharging part 200 so as to delicately cool and heat the whole interior. The adaptor 271 has an end 271*a* that is connected to the outlet 112 and an end 271*b* that is connected to one of the plurality of discharging units 210, so as to connect the discharging part 200 and the main body 100 to each other. The adaptor 271 simply has a cylindrical shape having the same diameter as the main duct 220 but has a shape that enables two discharging parts 200 to be connected to the main body 100 so as to form further various air currents.

The cover 261 and the adaptor 271 described above improve compatibility between the plurality of discharging units 210, the cover 261, and the adaptor 271 so as to combine the plurality of discharging units 210, the cover 261, and the adaptor 271 with one another according to the same method as a method of combining the plurality of discharging units 210 with one another. Therefore, the user freely manipulates the plurality of discharging units 210, the cover 261, and the adaptor 271. A blowing process of the air conditioning equipment 1 constituted as described above according to the present exemplary embodiment will now be described.

Referring to FIG. 1, in the air conditioning equipment 1 according to the present exemplary embodiment, interior air flows into the main body 100 through the inlet 111. The interior air is exchanged with heat through the heat exchanger and then flows toward the discharging part 200 through the outlet 112. The air flowing into the discharging part 200 flows sequentially into the plurality of discharging units 210 through the adaptor 271. Here, if the user wants to delicately cool and heat the interior, the user opens the cover 261 so as to enable most of air to be discharged toward an upper part of the air conditioning equipment 1 through the cover 261. On the contrary, if the user wants air to be discharged through the plurality of discharging units 210, the user closes the cover 261. Therefore, air flowing in the discharging part 200 is discharged into the interior through the discharging holes 244 and 254 of the plurality of discharging units 210.

Here, the user individually rotates the plurality of discharging units 210 to change directions of the openings 211 of the plurality of discharging units 210. In other words, the discharging unit 210 that is disposed at a lower part discharges air to the left side, and the discharging unit 210 that is disposed at an upper part discharges air to the right side. This manipulation enables the user to variously realize a discharging direction. Also, the user rotates the diffusers 230 on the main ducts 220 to manipulate whether the openings 221 will meet what parts of the closing parts 231, the low-speed parts 241, and the high-speed parts 251 of the diffusers 230.

In other words, if the user does not want to discharge air in a direction where the user is positioned, the user rotates the diffusers 230 at a preset angle to block the openings 221. Also, if the user wants delicate wind, the user rotates the diffusers 230 at a preset angle to open the openings 221 so as to enable the openings 221 to meet the low-speed parts 241. If the user wants direct wind through air having a fast flow velocity, the user rotates the diffusers 230 at a preset angle to open the openings 221 so as to enable the openings 221 to meet the high-speed parts 251. This manipulation enables the user to variously realize a discharging velocity and a discharging direction of discharged air.

Also, rotations of the main ducts 220 and the diffusers 230 described above are driven according to a manual method or an automatic method. Also, the connection parts 240 of the diffusers 230 are disposed in arbitrary positions to open only parts of the openings 221. On the contrary, the connection parts 240 of the diffusers 230 are fixed only in particular positions by using the fixing parts 281 and the fixing grooves 224 that fix three types of modes. In addition, the user supplies water like supplying water to the water supply part 131 formed on the upper surface of the main body 100, to humidify the interior through the humidifying unit 130. Air conditioning equipment 2 according to another exemplary embodiment of the present general inventive concept will now be described with reference to FIG. 7. The same elements of the present exemplary embodiment as those of the previous exemplary embodiments are denoted by the same reference numerals, and thus their detailed descriptions are omitted. Also, only different elements of the present exemplary embodiment from those of the previous exemplary embodiments will be described.

The air conditioning equipment 2 of the present exemplary embodiment includes a plurality of discharging units 210 that include diffusers 230 having different sizes and are respectively differently disposed. In the previous exemplary embodiment, as the diffusers 230 of the discharging units 210 become far away from the outlet 112, the diffusers 230 of the discharging units 210 are gradually arranged in order of their large sizes. However, in the present exemplary embodiment, as the diffusers 230 of the discharging units 210 become far away from the outlet 112, the diffusers 230 of the discharging units 210 are gradually arranged in order of their small sizes. According to this arrangement, the air conditioning equipment 2 of the present exemplary embodiment discharges air low and far. In other words, a user disposes the discharging units 210 as the user wants. Also, although not shown, the discharging units 210 are disposed so that a size of the diffuser 230 disposed in center is largest or are arbitrarily disposed regardless of sizes of the diffusers 230.

Figure 8:
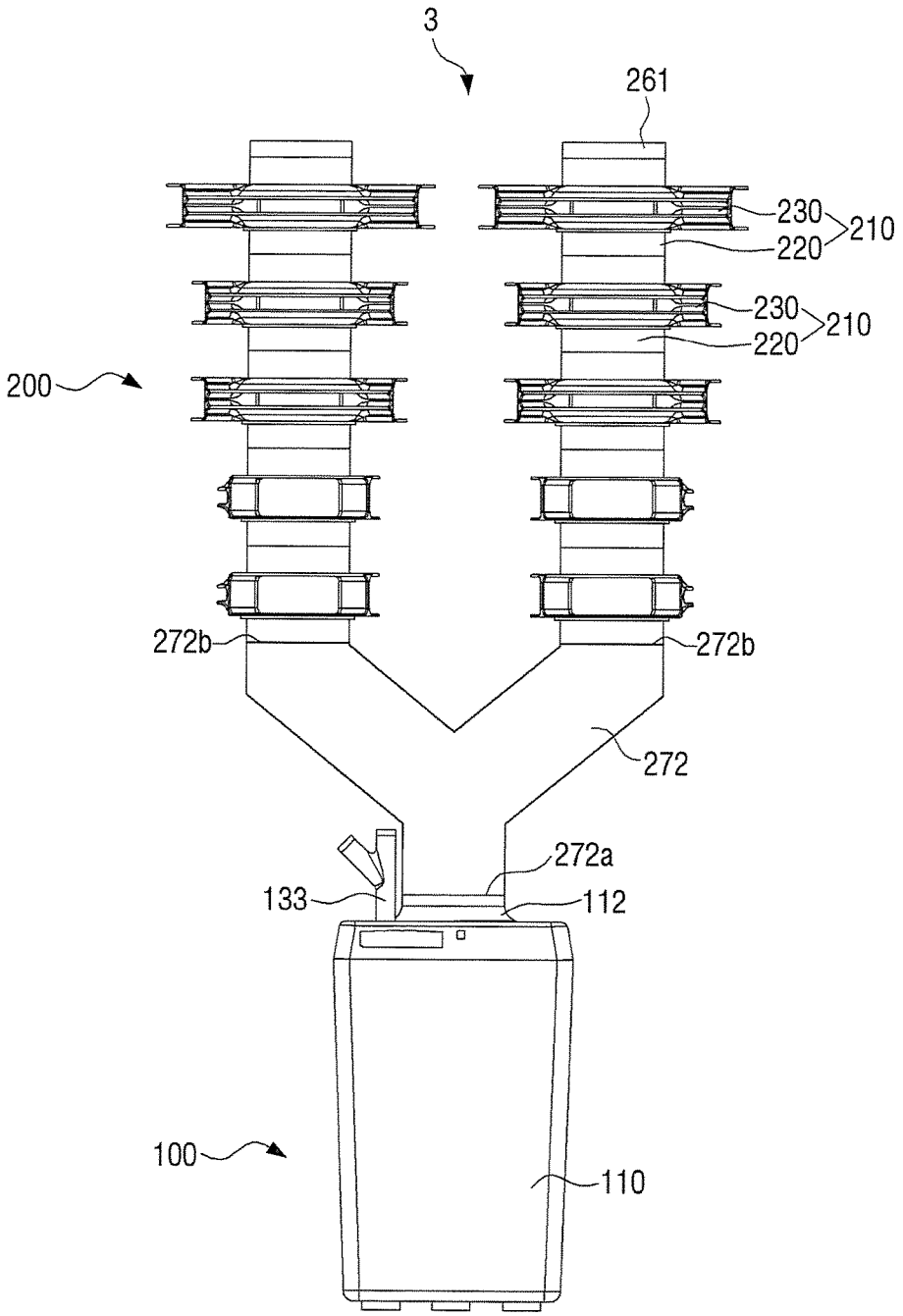
FIG. 8 is a perspective view of an example air conditioning equipment according to this disclosure.

Air conditioning equipment 3 according to another exemplary embodiment of the present general inventive concept will now be described with reference to FIG. 8. The same elements of FIG. 8 as those of FIGS. 1 through 6 are denoted by the same reference numerals, and thus their detailed descriptions are omitted. Also, only different elements of FIG. 8 from those of FIGS. 1 through 6 will be described. The air conditioning equipment 3 according to the present exemplary embodiment includes an adaptor 272 that divides a flow path of air discharged from an outlet 112 into two flow paths. Therefore, an end 272*a* of the adaptor 272 is connected to the outlet 112, and two other ends 272*b* of the adaptor 272 are respectively connected to discharging parts 200.

In other words, the air conditioning equipment 3 according to the present exemplary embodiment includes two discharging parts 200 to form further various air currents. Here, diameters of the outlet 112 and the discharging units 210 are standardized so as to enable a user to change the air conditioning equipment 1 of FIGS. 1 through 6 into a shape of the air conditioning equipment 3 of FIG. 8 and use the air condition equipment 1 having the changed shape only through a purchase of a new adaptor. Also, a flow path of air is divided into two flow paths in the present exemplary embodiment but is divided into three or more flow paths. Air conditioning equipment 4 according to another exemplary embodiment will now be described with reference to FIG. 9. The same elements of FIG. 9 as those of FIGS. 1 through 6 are denoted by the same reference numerals, and thus their detailed descriptions are omitted. Also, only different elements of FIG. 9 from those of FIGS. 1 through 6 will be described.

The air conditioning equipment 4 of the present exemplary embodiment includes outlets 112 that are formed in both sides of a main body 100. Therefore, the inlet 111 is formed in one of an upper surface, a lower surface, a front surface, and a back surface of the main body 100. Also, discharging parts 200 are respectively disposed in the outlets 112 to be perpendicular to a longitudinal direction of the main body 100. In addition, the outlets 112 are not limited thereto, and thus only one outlet 112 is formed so as to enable the discharging part 200 to be connected to only a side of the one outlet 112. Also, three or more outlets 112 are included. However, the outlets 112 are symmetric to each other based on the main body 100 in consideration of weights of the discharging parts 200.

Bowing fans are included so as to correspond to the number of outlets 112 and thus are respectively disposed in positions corresponding to the outlets 112. On the contrary, if a plurality of outlets 112 is included, a blowing fan having a larger blowing air capacity is used. The air conditioning equipment 4 of the present exemplary embodiment is useful if a height of a place to be cooled and heated is low. Air conditioning equipment 5 according to another exemplary embodiment of the present general inventive concept will now be described with reference to FIG. 10. The same elements of FIG. 10 as those of FIGS. 1 through 6 are denoted by the same reference numerals, and thus their detailed descriptions are omitted. Therefore, only different elements of FIG. 10 from those of FIGS. 1 through 6 will be described.

Figure 9:
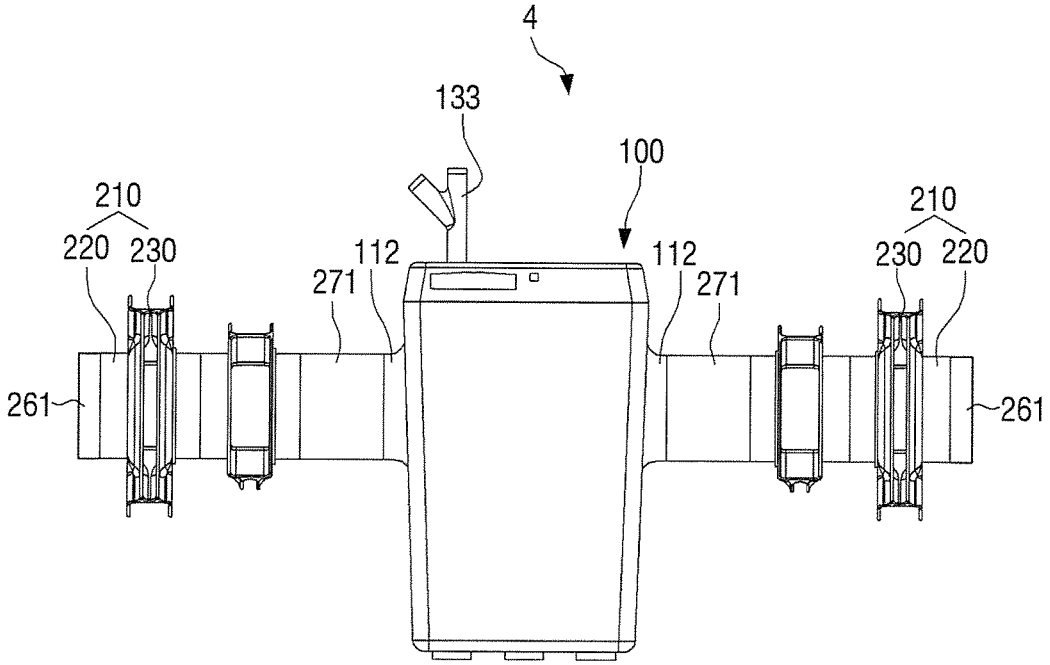
FIG. 9 is a perspective view of an example air conditioning equipment according to this disclosure.
Figure 10:
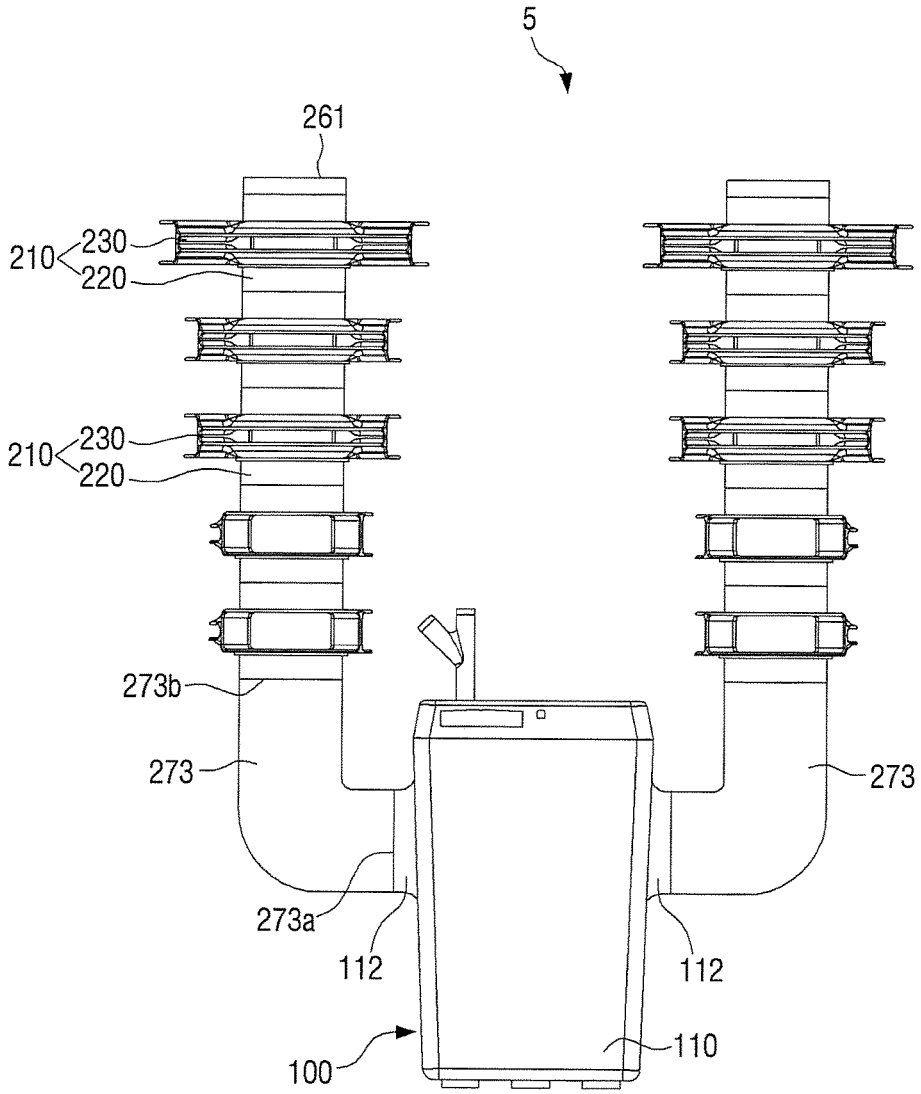
FIG. 10 is a perspective view of an example air conditioning equipment according to this disclosure.
Figure 11:
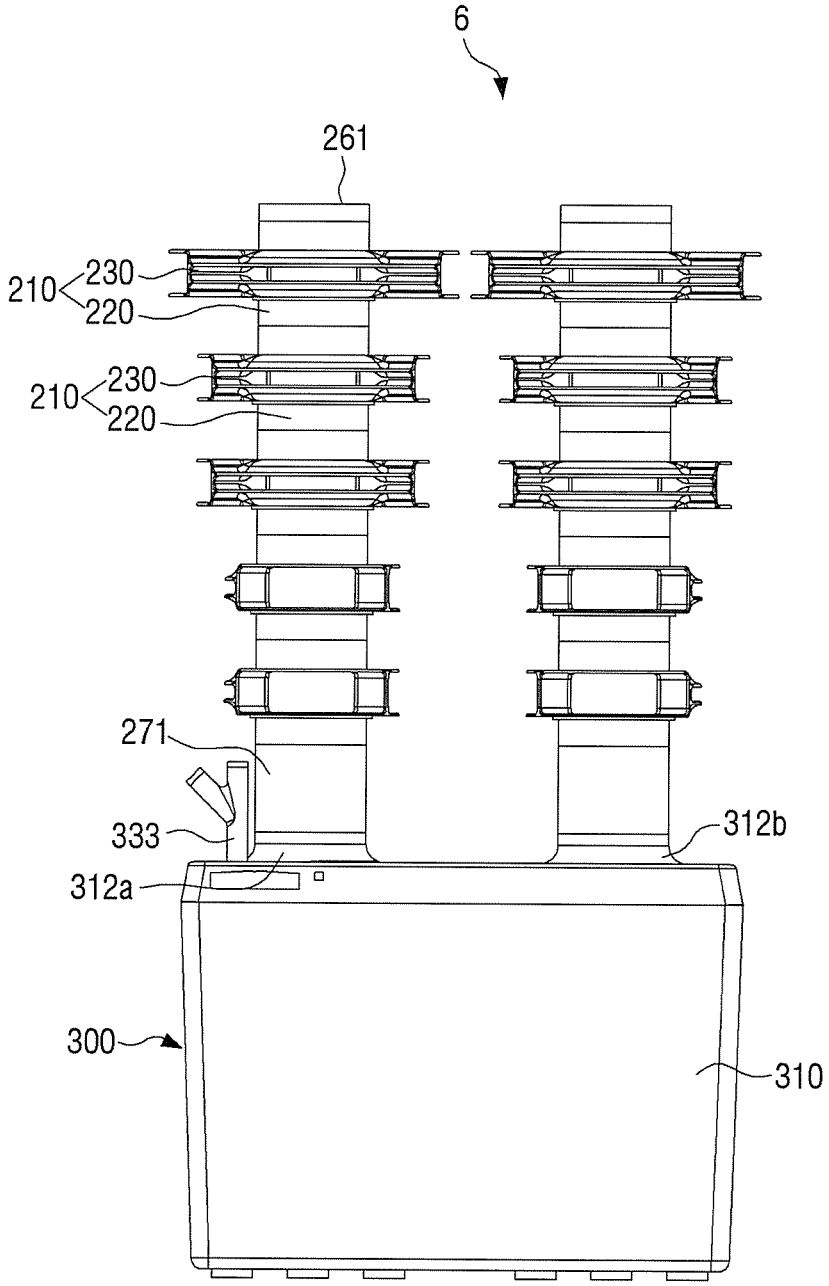
FIG. 11 is a perspective view of an example air conditioning equipment according to this disclosure.
Figure 12:
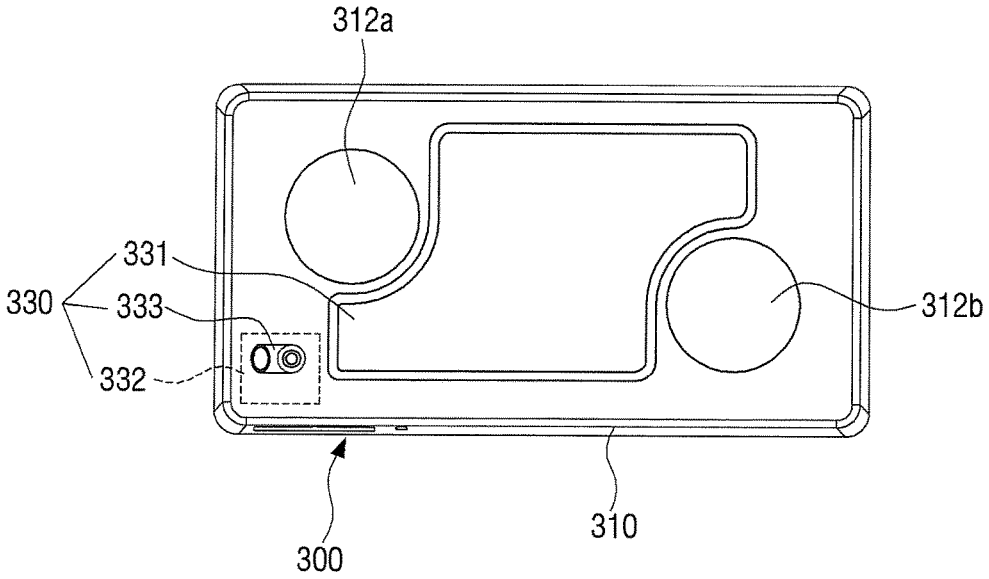
FIG. 12 is a plan view of an example air conditioning equipment from which discharging units are separated according to this disclosure.

The air conditioning equipment 5 of the present exemplary embodiment includes outlets 112 that are disposed in both sides of a main body 100 as in the exemplary embodiment described with reference to FIG. 9. However, the air conditioning equipment 5 includes adaptors 273 having "L" shapes for disposing discharging parts 200 in the same direction as a longitudinal direction of the main body 100. Ends 273*a* of the adaptors 273 are connected to the outlets 112 in a direction perpendicular to the longitudinal direction of the main body 100, and ends 273*b* of the adaptors 273 are connected to discharging units 210 in the same direction as the longitudinal direction of the main body 100.

The air conditioning equipment 5 of the present exemplary embodiment forms further various discharged air currents in comparison with the previous exemplary embodiments wherein one discharging part 200 is disposed. Air conditioning equipment 6 according to another exemplary embodiment of the present general inventive concept will now be described with reference to FIGS. 11 and 12. The same elements of FIGS. 11 and 12 as those of FIGS. 1 through 6 are denoted by the same reference numerals, and thus their detailed descriptions are omitted. Therefore, only different elements of FIGS. 11 and 12 from those of FIGS. 1 through 6 will be described. The air conditioning equipment 6 of the present exemplary embodiment includes a main body 300 having a larger heat exchange capacity than in the above-described exemplary embodiments and a housing 310. A first outlet 312*a* and a second outlet 312*b* are formed in an oblique direction on an upper surface of the main body 300. This is to make a distance between the first and second outlets 312*a* and 312*b* maximum so as to prevent interferences between diffusers 230 when discharging parts 200 are connected to one another.

The discharging parts 200 are respectively connected to the first and second outlets 312*a* and 312*b* to form more various discharged air currents than in the exemplary embodiments where one discharging part 200 is disposed. The humidifying unit 330 includes a water supply part 331, a humidifying part 332, and a nozzle 333. The water supply part 331 that is larger than in the exemplary embodiment described with reference to FIGS. 1 through 6 is disposed on an upper surface of the main body 300 so as to reduce the number of times water is supplied to a humidifying unit 330. If an area of a space to be cooled and heated is wide, the air conditioning equipment 6 of the present exemplary embodiment is used as large air conditioning equipment. Also, the discharging units 210 are the same as the discharging units 210 described in the previously exemplary embodiments and show an advantageous effect in terms of compatibility of products.

As described above, air conditioning equipment according to the present exemplary embodiment includes a plurality of discharging units that is variously disposed according to an intension of a user. Therefore, the air conditioning equipment adjusts a discharging velocity and a discharging direction as a user wants. Also, the user replaces only the plurality of discharging units with discharging units having different designs to feel like purchasing new air conditioning equipment. In addition, a whole design of the air conditioning equipment is manufactured like a tree planted into a flowerpot to give an eco-friendly feeling to the user so as to give an aesthetic effect to the user.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. Air conditioning equipment comprising:

a main body comprising a housing that includes a heat exchanger and a blowing fan, and an inlet and an outlet formed in an outer surface of the housing, wherein air flows into the inlet, and the air exchanged with heat is discharged through the outlet; and a discharging part comprising an end detachably combined with the outlet, wherein the discharging part comprises a plurality of discharging units configured to adjust a discharging velocity and discharging direction of the discharged air and to be connected to one another so as to be made into a module, wherein the discharging units comprise:

main ducts configured to be connected to the main body and comprising outer surfaces in which openings are formed; and diffusers configured to be combined with the outer surfaces of the main ducts so as to rotate on the outer surfaces of the main ducts, wherein the diffusers are configured to rotate in one direction or a reverse direction to adjust opened degrees of the openings.

2. The air conditioning equipment of claim 1, wherein the main ducts comprise connection parts configured to be formed at both ends of each of the main ducts so as to enable the plurality of discharging units to be connected to one another through the connection parts.

3. The air conditioning equipment of claim 1, wherein the diffusers comprise closing parts configured to be formed at some parts of the diffusers so as to close the openings and connection parts configured to be formed at other parts of the diffusers so as to be connected to the openings, wherein the closing parts and the connection parts are formed along circumferences of the diffusers.

4. The air conditioning equipment of claim 3, wherein the connection parts comprise at least two or more discharging holes having different areas.

5. The air conditioning equipment of claim 4, wherein areas of the at least two or more discharging holes are set by distances between first and second guide ribs formed at both ends of the diffusers.

6. The air conditioning equipment of claim 1, wherein the diffusers of the discharging units have different sizes.

7. The air conditioning equipment of claim 6, wherein as the diffusers of the discharging units become far away from the outlet, the diffusers of the discharging units are gradually arranged based on size beginning either with a diffuser having a largest size or with the diffuser having a smallest size.

8. The air conditioning equipment of claim 1, wherein the discharging part further comprises a cover configured to be detachably combined with another end of the discharging part.

9. The air conditioning equipment of claim 8, wherein the cover comprises:

a case comprising at least one opening and closing hole; and a shutter part configured to be rotatably combined with the case in order to open and close the at least one opening and closing hole.

10. The air conditioning equipment of claim 1, wherein the discharging part further comprises an adaptor configured to be disposed between the outlet and an end of the discharging part so as to be connected to the discharging part.

11. The air conditioning equipment of claim 10, wherein the adaptor divides a flow path of air discharged from the outlet into two or more flow paths, wherein a plurality of discharging parts are disposed to be respectively connected to the two or more flow paths.

12. The air conditioning equipment of claim 1, wherein at least one or more outlets are formed in an upper surface or a side of the main body, wherein a plurality of discharging parts are disposed so as to correspond to a number of outlets.

13. The air conditioning equipment of claim 1, wherein the discharging units further comprise filters configured to be disposed in the discharging units.

14. The air conditioning equipment of claim 1, wherein the main body further comprises a humidifying unit configured to adjust humidity, wherein the humidifying unit comprises:

a water supply unit configured to be disposed on an upper surface of the main body;

a humidifying part configured to be disposed in the main body so as to convert water supplied to the water supply unit into fine water particles; and a nozzle configured to spout the fine water particles.

* * * * *